United States Patent [19]

Tuningley et al.

[11] Patent Number: 4,824,055

[45] Date of Patent: Apr. 25, 1989

[54] RAILROAD FROG

[75] Inventors: Allen J. Tuningley, Delta; Keith M. Barlow, New Westminster; Thomas R. Stanley, Vancouver, all of Canada

[73] Assignee: Nortrak Limited, Richmond, Canada

[21] Appl. No.: 9,731

[22] Filed: Feb. 2, 1987

[51] Int. Cl.[4] ..... E01B 7/10

[52] U.S. Cl. ..... 246/458

[58] Field of Search ..... 246/454, 457, 458, 460, 246/461, 468

[56] References Cited

U.S. PATENT DOCUMENTS

| | | | |
|---|---|---|---|
| 896,154 | 8/1908 | Reinoehl et al. | 246/458 |
| 3,263,076 | 7/1966 | Magnus et al. | 246/454 |
| 4,081,162 | 3/1978 | Frank | 246/458 |

*Primary Examiner*—Sherman D. Basinger
*Assistant Examiner*—Jesus D. Sotelo
*Attorney, Agent, or Firm*—Fetherstonhaugh & Co

[57] ABSTRACT

An improved railroad FROG of nearly shrink free casting and method of forming is disclosed. The FROG is comprised of a triangular shaped top area with an actual FROG point at the center of the casting, widening at one end to a heel and heel extension with flangeways adjacent each side to allow the passage of wheels. A throat is located ahead of the actual FROG point and extends forwardly to a toe end of the casting. The throat is bound by wings of the casting. The casting has a solid arched, ribbed supporting structure below the running surface of the casting.

14 Claims, 5 Drawing Sheets

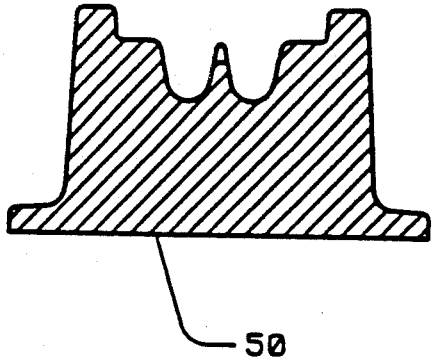
FIG 7 SECTION X - X
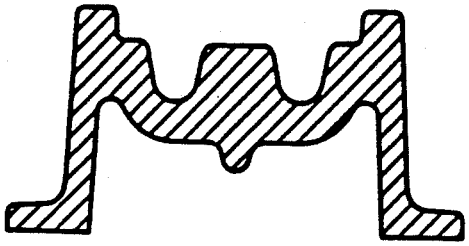
FIG 8 SECTION Y - Y
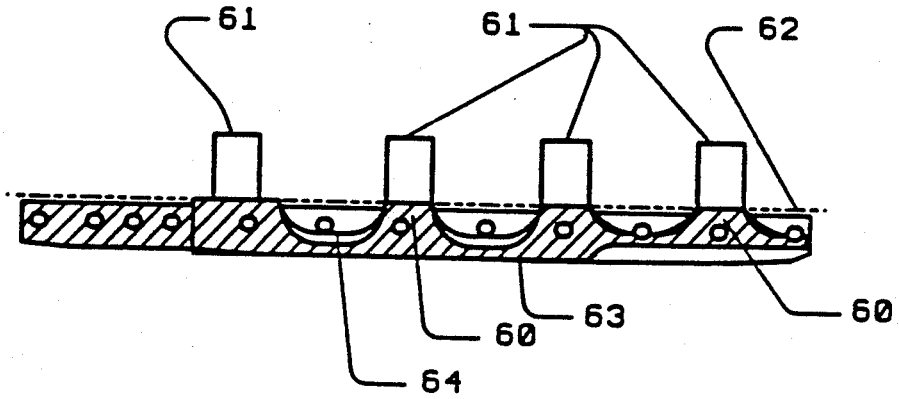
FIG 11

SECTION Z - Z

SECTION Z - Z

RAILROAD FROG

FIELD OF THE INVENTION

This invention relates to that part of a railway track system used within the turnout or crossing that is known as a FROG.

DESCRIPTION OF THE PRIOR ART

A turnout is an accumulation of parts forming a device used to move railway vehicles from one track to another. A crossing is a device of similar function and construction used to allow two railway tracks to cross A FROG is that part of the device within a turnout or crossing which permits wheels travelling along one rail to cross over another rail in a smooth action.

The intersection point of these two rails must have a gap to allow the passage of the railway wheels which have flanges to guide the wheels along the rail heads of diverging directions.

These two rails intersecting at an angle, with provision for a clear path for the wheel flanges to traverse, form a FROG. The FROG is invariably either a single piece casting known as a solid FROG or a cast center bound by bolts adjacent binding rails, to form a railbound FROG.

In either case, the center of the FROG is a casting having a nearly triangular shape flat top surface, running from the point of the triangle known as the theoretical FROG point to the base side forming a line between the two running rails known as the heel. The opposite end of the casting from the heel is known as the toe. From the switch of the turnout which first causes the wheels to diverge from their normal path the FROG guides the wheel first through the toe, over the flangeway gap, past the FROG point and out through the heel on to the diverging track. The vertical load bearing wheel rail contact area traces a line on top of the FROG as the wheel passes over it, and the lateral wheel rail contact traces a line on the side of the flangeway 0.625 inch below the top of the FROG. The heel of the FROG has an integrally cast heel extension with holes through it to facilitate the attachment of rails to the casting and transition of wheel contact off the casting onto conventional rail.

The center of a railbound FROG, or the whole FROG in the case of a solid FROG is a casting, which must carry heavy loads, with great frequency, in high impact conditions due to wheel imperfections and discontinuity over the throat ahead of the FROG point. Due to the severe demands placed on the casting it is usually constructed of austenitic manganese steel. This steel has a high ability to work harder, thereby resisting abrasive wear, and has a high fracture toughness to resist cracking under the repeated load-unload cycles.

Even austenitic manganese castings, while resistant to wear, will under heavy use wear to the point that vertical reduction in height accentuates impact and either breaks the casting or causes the wheels to leave their design path i.e. derail. Normally the FROG will be removed from the track before this severe damage results and weld deposited material will restore the FROG to its original shape.

However, the current design of FROG castings has an inherent problem of low standards of internal solidity. Internal solidity is a measure of the degree to which a casting is solid and continuous, without weakness or void caused by improperly controlled shrinkage during the cooling of the casting.

Castings are formed by pouring molten metal into preshaped molds that cause the metal to cool into a desired shape. As hot metal cools it contracts. The outermost area of the casting cools, solidifies and shrinks first; with time the cooling process continues, with the last area to cool being the center of the thickest portion of the casting. As the last of the liquid metal contracts there is less mass of metal than space it occupied when hot and a vacuum void occurs.

Casting designers frequently use risers to create a large mass of metal to feed additional molten metal to the last places to cool, thereby containing shrinkage to the riser which is cut off the solidified casting and discarded. The FROG castings are long and thin and cooling occurs evenly along the sections of the casting allowing the risers placed at the ends of the casting to feed only the ends. Shrinkage voids occur along the center line of the thickest sections of the casting. The shrinkage voids are irregularly shaped and found under the point or close to it because of the greater thickness in this area. Cracking originating in the shrinkage voids frequently works its way to the surface in worn FROGS during flexing as the FROG is loaded and unloaded with traffic passing over it, and the reduction in height brings the cracks closer to the surface.

Welding repairs necessitate removing all surface cracking before starting to build up new material. Failure to remove all cracks before welding causes the cracks to immediately enter a newly placed metal. Removal of all cracks frequently involves completely removing a section of the FROG. Extensive removal is costly as is the placement of new weld material to restore the original section. Many FROGS cannot be repaired even once, while without cracks, a FROG should survive many rebuildings.

In U.S. Pat. No. 4,081,162 which issued to Frank, it has been reasoned that if the supporting structure under the FROG was to extend with vertical walls from a gage line to an integral baseplate bearing on the ties, the problem would be solved. This solution will provide a stiffer casting more resistant to flexure, but does not reduce cracking or shrinkage voids. In fact, by introducing thinner sections on the underside of the casting it moves the shrinkage voids closure to the running surface.

The problems which this invention confronts are two namely, shrinkage voids which cause cracking and fatigue and worn castings that cause failures.

SUMMARY OF THE INVENTION

Therefore, an object of the present invention is to provide FROG construction in which the understructure of the FROG is modified to provide solid sections of casting from the running surface to be flush with the base of the FROG at each location where there is a supporting tie without change to the running surface of the casting. Between the solid sections of the casting, the shape returns to nearly the present design gradually through an arched, ribbed supporting structure. Each solid section extends beyond its final baseline casting and is cut back to required size and the waste discarded during finishing. This allows each solid base section to act as a riser to feed molten metal half way into the adjacent ribbed, arched structure. As the casting cools it results in a FROG without any significant shrinkage and greatly enhanced resistance to flexure.

Accordingly, an aspect of the present invention is to provide a railroad FROG of nearly shrink-free casting, comprising: a triangular shape top area with an actual FROG point at the center of the casting, widening at one end to a heel and heel extension, with flangeways adjacent to each side to allow the passage of wheels; a throat ahead of said FROG point extending forward to a toe end of said casting, said throat being bound by wings of said casting; said casting having a solid arched, ribbed supporting structure below the running surface of said casting.

According, a second aspect of the present invention there is provided a method of forming nearly shrink-free FROG castings, comprising the steps of: forming by casting a FROG having a triangular shaped top area with an actual FROG point at the center of the casting, widening at one end to a heel and heel extension, with flangeways adjacent to each side to allow the passage of wheels, a throat ahead of said actual FROG point extending forward to a toe end of said casting, said throat being bound by wings of said casting, said casting having a solid arched, ribbed supporting structure below the running surface of said casting; forming a riser which extends beyond said base at each section of said arched, ribbed with supporting structure so as to permit the feeding of molten metal to adjacent arched and ribbed structures; allowing said casting to cool; cutting said risers at said base; and discarding said cut risers.

DRAWINGS

Particular embodiments of the invention will be understood in conjunction with accompanied drawings in which:

FIG. 7 is a sectional view taken along line X—X of FIG. 6;

FIG. 8 is a sectional view taken along lines Y—Y of FIG. 6;

FIG. 11 is a sectional view similar to that in FIG. 9 but as would be seen after being cast.

DESCRIPTION OF THE PREFERRED EMBODIMENTS

Figure 1:
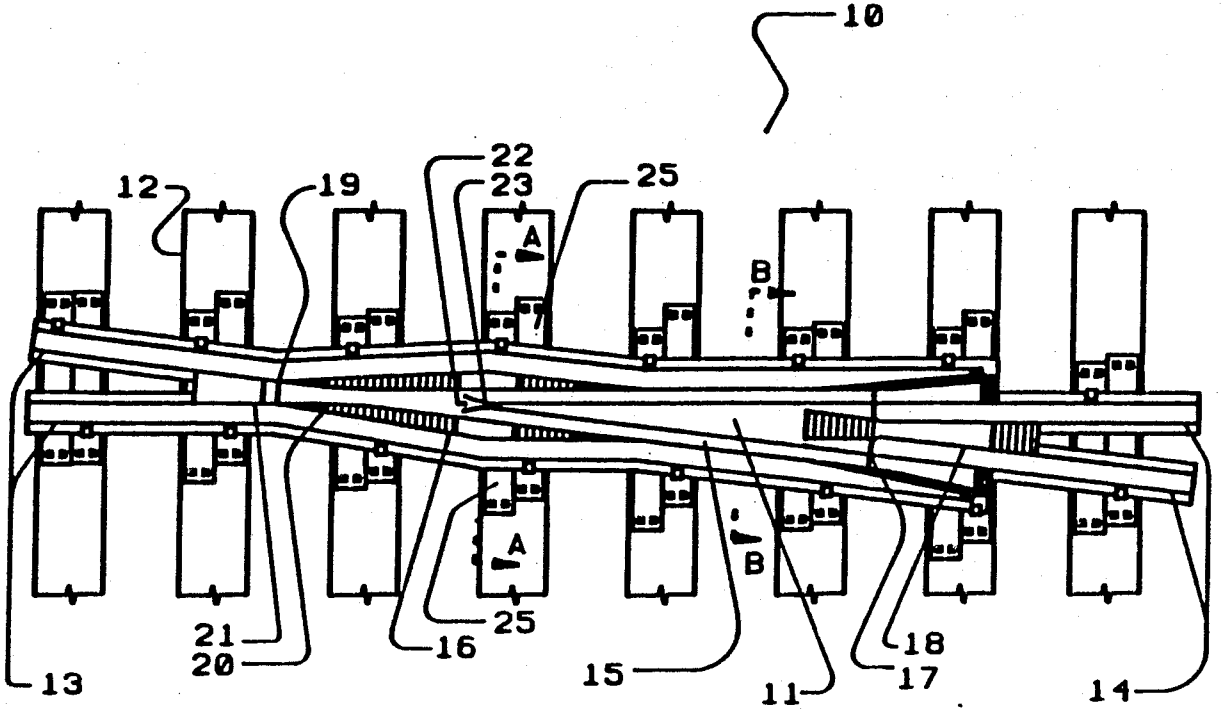
FIG. 1 is a plan view of a railbound railroad FROG according to one embodiment of the invention.

Referring now to FIG. 1 we have shown at reference numeral 10 a typical railbound railroad FROG according to the present invention. This FROG is comprised of a casting 11 and which is more clearly shown in FIG. 2. The FROG is secured onto a series of ties 12 and includes a pair of wing rails 13 and a pair of heel rails 14.

FROG casting 11 is separated from the main FROG body at flangeway 15 and casting wings 16. Casting 11 is provided at one end with a heel 17 and heel extension 18 adapted to be fitted between heel rails 14. At the opposite end, casting 11 is provided with a toe 19 and toe throat 20 which will be located before a toe block 21 on frog 10. The theoretical FROG point of casting 11 is shown at reference numeral 22 whereas the actual point is located at reference numeral 23. Heel extension 18 is integrally cast to heel 17 and is provided with a series of holes 24 adapted to facilitate the attachment of heel rails 14 to the casting and also to facilitate the transition of wheel contact off the casting onto conventional rails.

Figure 3:
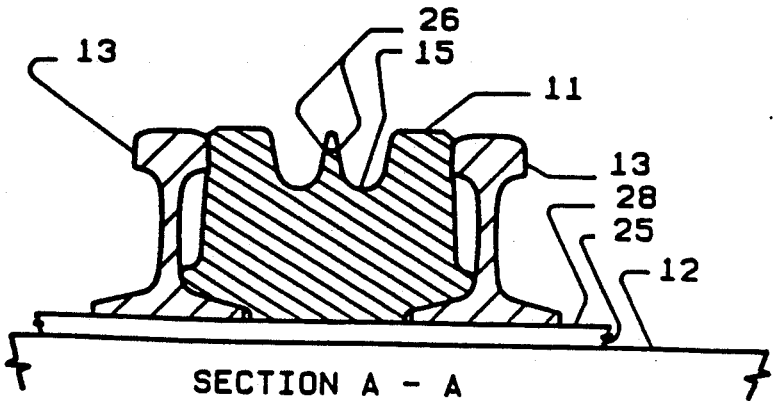
FIG. 3 is a sectional view taken along lines A—A of FIG. 1.

Referring now to FIG. 3, we have shown a sectional view taken along lines A—A of FIG. 1. At this particular section, the casting insert 11 is solid. This section of the casting is positioned above a standard wood tie 12 adapted to receive the load from the FROG through a series of baseplates 25. The Figure depicts the shape of flangeways 15 and casting 11 between wing rails 13. Reference numeral 26 depicts the gage lines located at the actual FROG point 23.

Figure 4:
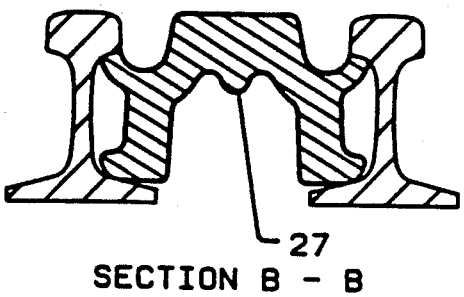
FIG. 4 is a sectional view taken along lines B—B of FIG. 1.

Referring now to FIG. 4, we have shown a sectional view taken along lines B—B of FIG. 1. This section shows the location of an arched rib 27 which is located between pairs of wood ties 12 shown in FIG. 1.

Figure 2:
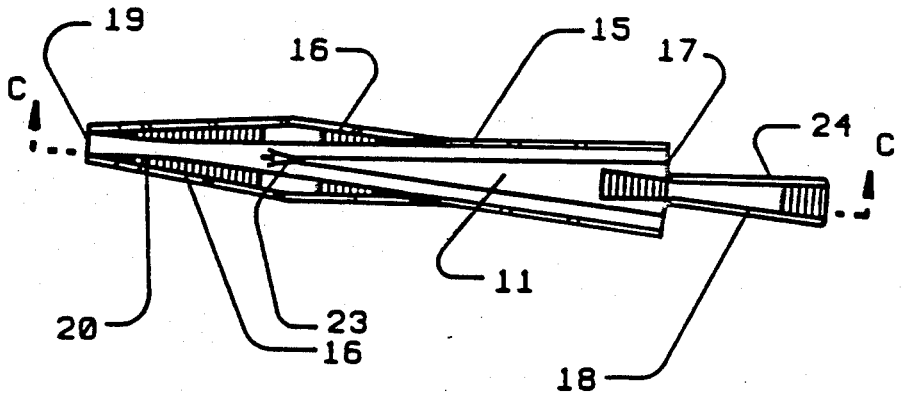
FIG. 2 is a plan view of the casting used in the railroad FROG of FIG. 1.
Figure 5:
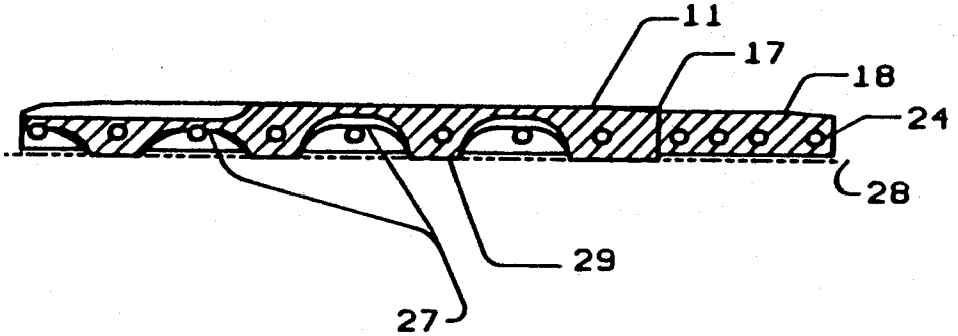
FIG. 5 is a sectional view taken along lines C—C of FIG. 2.

Referring now to FIG. 5 we have shown a sectional view taken along lines C—C of FIG. 2 depicting the shape of the FROG's understructure according to the first embodiment of the present invention. In this particular section, arched ribbed spaces 27 are located between each solid base section 29 of the casting 11. Each base section 29 is positioned along a base line 28 and are adapted to be supported on each wood tie 12 as shown in FIG. 1 and 3.

Figure 6:
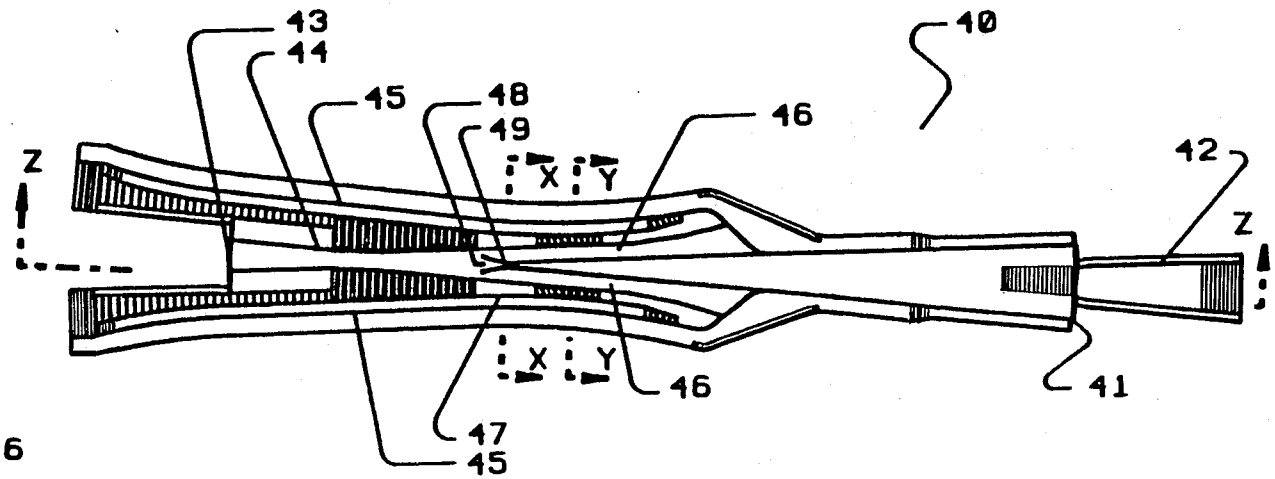
FIG. 6 is a plan view of the solid railroad FROG in accordance with another embodiment of the present invention.

FIG. 6 provides a plan view of a solid railroad FROG in accordance with this invention. Solid railroad FROG 40 operates on the same principle as railbound railroad FROG 10 shown in FIG. 1. FROG 40 is provided at one end with a heel 41 and integral heel extension 42 and at its other end includes a toe 43 and toe throat 44. A pair of guards 45 are provided along each edge of the FROG. Similarly, flangeways 46 casting wings 47, a theoretical FROG point 48 and an actual FROG point 49 are provided as well.

FIG. 7 depicts a sectional view taken along lines X—X of FIG. 6. This particular section shows the location of the solid base 50 as would be located and supported above a wooden tie. FIG. 8 shows a sectional view taken along lines Y—Y of FIG. 6. This section of the FROG is located adjacent to the solid base section 50 of FROG 40 and clearly depicts the arched ribbed part of this particular FROG.

Figure 9:
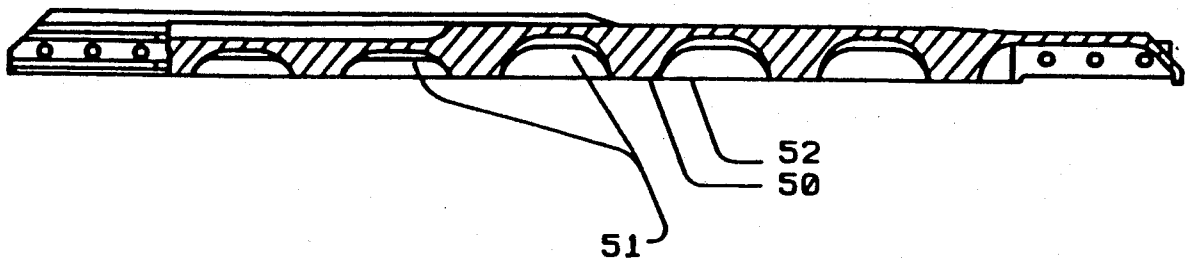
FIG. 9 is a sectional view taken along lines Z—Z of FIG. 6.

FIG. 9 is a sectional view taken along the line Z—Z of FIG. 6 and clearly depicts the location of the arched ribbed spaces 51 located adjacent each solid base section 50 positioned and supported above a wooden tie. Each base section is located along a base line depicted by Reference numeral 52.

Figure 10:
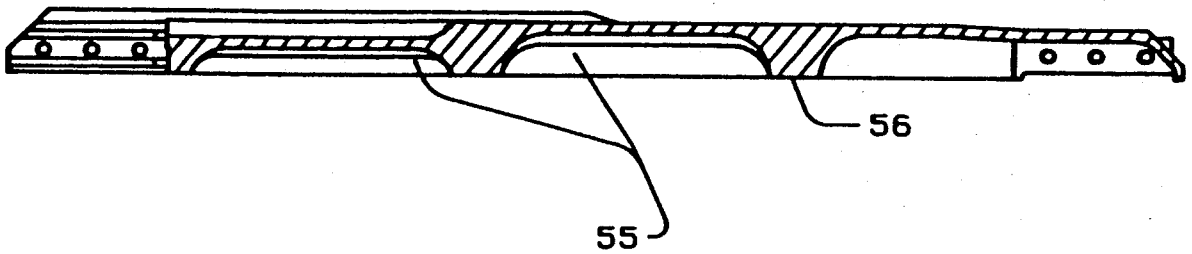
FIG. 10 is a sectional view taken along lines Z—Z of FIG. 6 of another embodiment of the present invention.

Referring now to FIG. 10 we have shown according to a second embodiment of the present invention a sectional view taken along lines Z—Z of FIG. 6. In this particular embodiment, the arched ribbed spaces 55 are located between solid base sections 56 supported on alternate wood ties rather than every tie as in FIG. 5 and 9.

FIG. 11 is a sectional view similar to that shown in FIG. 5 except that the casting has been turned over to indicate its orientation when cast. The Figure shows how the solid bases 60, when cast are extended to act as risers 61, and then cut off along base line 62 and discarded.

Since during the formation of the casting, the last area to cool is the center of the thickest portion of the casting, vacuum void occurs in the central region of that thickest portion. Accordingly, by providing risers 61 a large mass of metal is created which feeds additional molten metal to the last places to cool, thereby containing shrinkage to the riser which is cut off the solidified casting and discarded. Since the FROG castings are long and thin and cooling occurs evenly along the sections of the casting allowing the risers usually placed at the ends of the casting to feed only the ends, shrinkage voids occur along the center line of the thickest sections of the casting. Therefore, instead of having a series of voids located along the surface 63 of the casting, which is in effect the area of greatest stress, the voids will move closer to risers 61 somewhere along base line 62 where their location does not effect the strength and durability of the casting. Accordingly, as shown in FIG. 11, the under structure of the present FROG is modified to provide solid sections of castings 60 from the running surface 63 to be flush with the base of the FROG depicted by dotted line 62 at each location where there is a supporting tie without change to the running surface of the casting. Between the solid sections, the shape of the casting gradually returns to nearly the standard design shape through an arched, ribbed supporting structure 64. Each solid section 60 extends beyond its final base line 62 when cast and is cut back to required size and the waste is discarded during finishing. This allows each base section to act as a riser to feed molten metal halfway into the adjacent ribbed arched structure. As the casting cools it results in a FROG without any significant shrinkage and greatly enhanced resistance to flexure.

As will be apparent to those skilled in this art in light of the foregoing disclosure, many alterations and modifications are possible in the practise of this invention without departing from the spirit and scope thereof. Accordingly, the scope of the invention is to be construed in accordance with the substance defined by the following claims.

I claim:

1. A railroad FROG casting comprising:

a main casting portion having a top area of triangular shape;

a heel extension at one end of said main casting portion;

said top area widening toward said heel portion;

means defining flangeways adjacent opposite sides of said top area;

said flangeways converging towards a throat; and said throat extending towards a toe;

a plurality of solid sections spaced apart along said casting and each comprising a solid mass of metal extending to opposite side surfaces of said casting and from top to bottom of said casting;

a plurality of downwardly open recesses spaced apart along said casting and formed in the underside of said casting between successive ones of said solid sections; and supporting structures integral with said solid sections and bridging said recesses.

2. A railroad FROG as defined in claim 1 wherein said casting has sides formed to fit into and rest on flanges of binding wing rails, said casting being bound to said wing rails by means of bolts.

3. A railroad FROG as defined in claim 1 wherein said casting is solid.

4. A railroad FROG as defined in claim 3 wherein said throat is bound by wings of the casting extending to said toe and toe extensions with integral guards having exterior formed sides from the top of the FROG to the base of the casting.

5. A railroad FROG casting as claimed in claim 4, wherein said recesses are arch-shaped.

6. A railroad FROG casting as claimed in claim 5, further comprising an arched rib extending centrally of and in the longitudinally direction of said casting in each of said recesses.

7. A railroad FROG casting as claimed in claim 1, wherein said supporting structures are arch-shaped.

8. A railroad FROG casting as claimed in claim 7, further comprising an arched rib extending centrally of and in the longitudinal direction of the casting in each of said recesses.

9. A railroad FROG casting as claimed in claim 1 further comprising boltholes extending transversely of said casting through said solid sections.

10. A method of forming nearly shrink free FROG castings, comprising steps of:

forming by casting a FROG having a base, a triangular shaped top area with an actual FROG point at the center of the casting, widening at one end into a heel and heel extension, with flange ways adjacent each side to allow passage of wheels, a throat ahead of said actual FROG point extending forward to a toe end of said casting, said throat being bound by wings of said casting; said casting having a solid arched, ribbed supporting structure below the running surface of said casting;

forming a riser which extends beyond said base at each solid section of said arched, ribbed supporting structure so as to permit the feeding of molten metal to adjacent arched and ribbed structure;

allowing said casting to cool;

cutting said risers at said base; and discarding said risers.

11. A method as defined in claim 10 wherein a riser is formed where supporting ties are located.

12. A method as defined in claim 10 wherein a riser is formed where alternate ties are located.

13. A method as defined in claim 10 wherein a riser is formed where at least one supporting tie is located.

14. A method of manufacturing a railroad FROG casting, comprising the steps of pouring molten metal to form a casting having a main casting portion having an underside of triangular shape, a heel extension at one end of said main casting portion, said triangular shape widening towards said heel extension inverted flangeways adjacent opposite sides of said triangular shape and converging towards a throat, a plurality of solid sections spaced apart along the casting, said solid sections each comprising a solid mass of metal extending the width of said casting and from top to bottom of said casting, a plurality of upwardly open, inverted arch-shaped recesses in the top of said casting between successive ones of said solid sections, and inverted supporting structures integral with said solid sections and extending beneath said recesses, said solid sections comprising risers which extend upwardly from said casting and serving to feed the molten metal to said supporting structures, and subsequently removing said risers, whereby shrinkage and void formation are counteracted.

* * * * *